US006913482B1

(12) United States Patent
Wu

(10) Patent No.: US 6,913,482 B1
(45) Date of Patent: Jul. 5, 2005

(54) ELECTRICAL CONNECTING DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/909,173

(22) Filed: Jul. 29, 2004

(51) Int. Cl.[7] ..... H01R 11/00
(52) U.S. Cl. ..... 439/502; 439/607
(58) Field of Search ..... 439/502, 607, 439/609, 610, 76.1, 352, 357

(56) References Cited

U.S. PATENT DOCUMENTS 6,280,243 B1 * 8/2001 Liu et al. ..... 439/502
6,607,397 B1 * 8/2003 Zhang et al. ..... 439/357
6,672,896 B1 * 1/2004 Li ..... 439/502
6,705,894 B1 * 3/2004 Comerci et al. ..... 439/607
6,719,591 B1 4/2004 Chang
6,746,273 B1 * 6/2004 Liu et al. ..... 439/502
6,776,658 B2 * 8/2004 Tang ..... 439/607

* cited by examiner

*Primary Examiner*—Hien Vu
(74) *Attorney, Agent, or Firm*—Wei Te Chung

(57) ABSTRACT

An electrical connecting device (100) used for connecting multiple connectors comprises a first connector (1), a number of second connectors (2), and a cable means (3). Each connector comprises a number of contacts (64) therein. The cable means comprises a number of lines (301) therein. One ends of the lines (31) are bundled together to terminated to the first connector, another ends are divided into a number of individual sets (32), and the another ends of the lines of each set are terminated to a corresponding second connector, thus that successfully building a fun out connecting solution in InfiniBand™ application.

8 Claims, 10 Drawing Sheets

ELECTRICAL CONNECTING DEVICE

BACKGROUND OF THE INVENTION

1. Field of the Invention

The present invention generally relates to a connecting device, and more particularly to an electrical connecting device for use in InfiniBand™ application.

2. Description of Related Art

Following the popularity of the Internet, information access speed becomes an important issue. Although the information processing speed of a central process unit (CPU) of a internet data center, i.e., a computer or a server, is increased enormously, information processing speed of I/O port devices of the machine is still relatively low, which results in that information still can not be accessed by the machine from the Internet with a speed as quickly as expected.

To solve this problem, an InfiniBand I/O port specification is proposed, which defines three levels of link performance—1×running at 2.5 Gbits/sec, 4×running at 10 Gbits/sec and 12×running at 30 Gbits/sec. Generally, a 1×InfiniBand connector has two pairs of signal contacts, a 4×InfiniBand connector has eight pairs of signal contacts, and a 12×InfiniBand connector has 24 pairs of signal contacts. Further, each level of the InfiniBand connector comprises a plurality of grounding contacts, and the ground contacts and the pairs of signal contacts of each connector are alternatively arranged in an array.

A cable connector assembly, which connectors comply with InfiniBand I/O port specification and are connected with both ends of the cable, is used for connections of sever—sever and severs to large storages. In application, when a server equipped with a 12×InfiniBand I/O port is to be connected with a server having a 4×InfiniBand I/O port by a cable connector assembly, most of the contacts assembled in the 12×InfiniBand connector are unemployed in use. Besides, a sever used in some large internet data centers has to provide more than one InfiniBand I/O ports thereon for transmitting data to plural servers or large storages via corresponding number of cable connector assemblies, which results in only a small space left for other ports disposed and the increasing the cost both in manufacturing and assembling.

Hence, an improved electrical connecting device is desired to overcome the disadvantages of the related art.

BRIEF SUMMARY OF THE INVENTION

Accordingly, the object of the present invention is to provide a connecting device which simplifying an electrical device building a fan out connection with other electrical devices in InfiniBand™ application.

In order to achieve the above-mentioned object, an electrical connecting device used for connecting multiple connectors comprises a first connector, a plurality of second connectors and a cable means. Each connector comprises a plurality of contacts therein. The cable means comprises a plurality of lines therein. One ends of the lines are bundled together to terminated to the first connector, another ends are divided into a plurality of individual sets, each of the sets is terminated to a corresponding second connector, thus that successfully building a fun out connecting solution in InfiniBand™ application.

Other objects, advantages and novel features of the invention will become more apparent from the following detailed description of the present embodiment when taken in conjunction with the accompanying drawings.

DETAILED DESCRIPTION OF THE INVENTION

Figure 1:
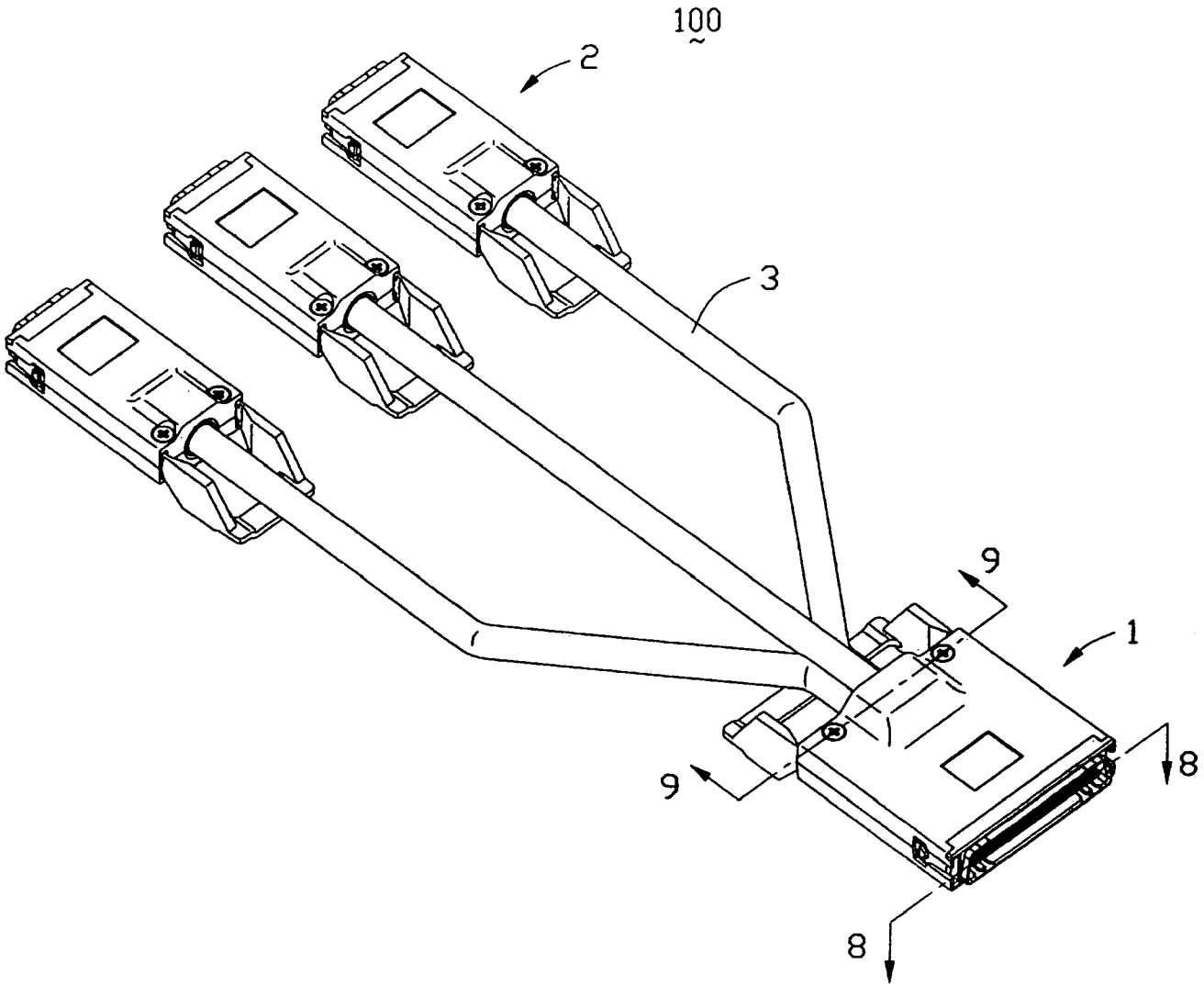
FIG. 1 is an assembly, perspective view of a connecting device in accordance with the present invention.

Reference will now be made to the drawing figures to describe the present invention in detail.

Referring to FIG. 1, an electrical connecting device 100 of the present invention comprises a first connector 1, three second connectors 2, and a cable means 3 electrically connecting the first connector 1 with the second connectors 2. The first connector 1 and the second connectors 2 are respectively designed to meet the 12× and 4×InfiniBand I/O port requirements. The first connector 1 and each second connector 2 have the same configuration excepted that the first connector 1 has a larger lengthwise dimension than that of the second connector 2 due to much more contacts 64 assembled therein, therefore only the first connector 1 will be described in great detail.

Figure 2:
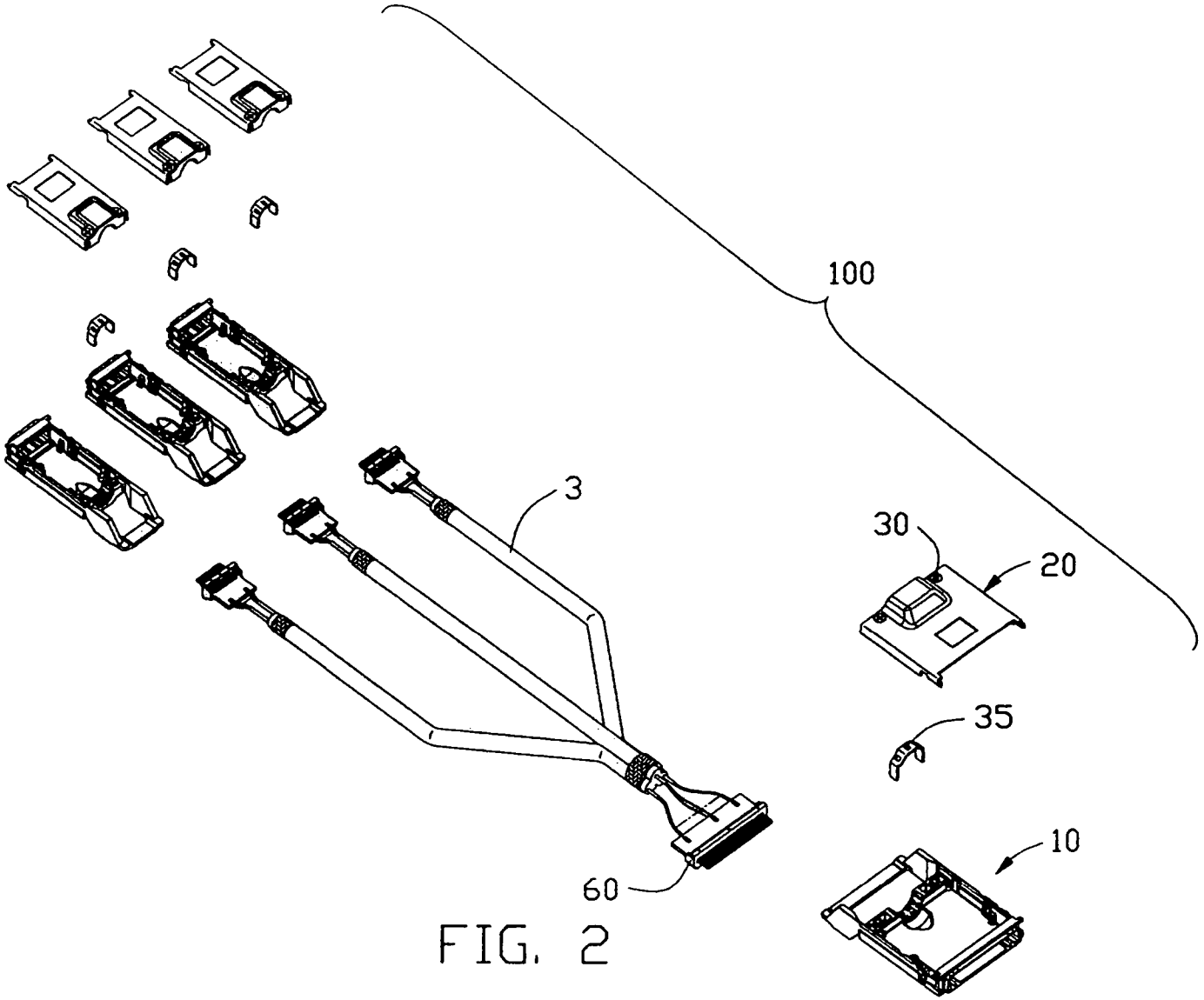
FIG. 2 is an exploded, perspective view of the electrical connecting device shown in FIG. 1.
Figure 5:
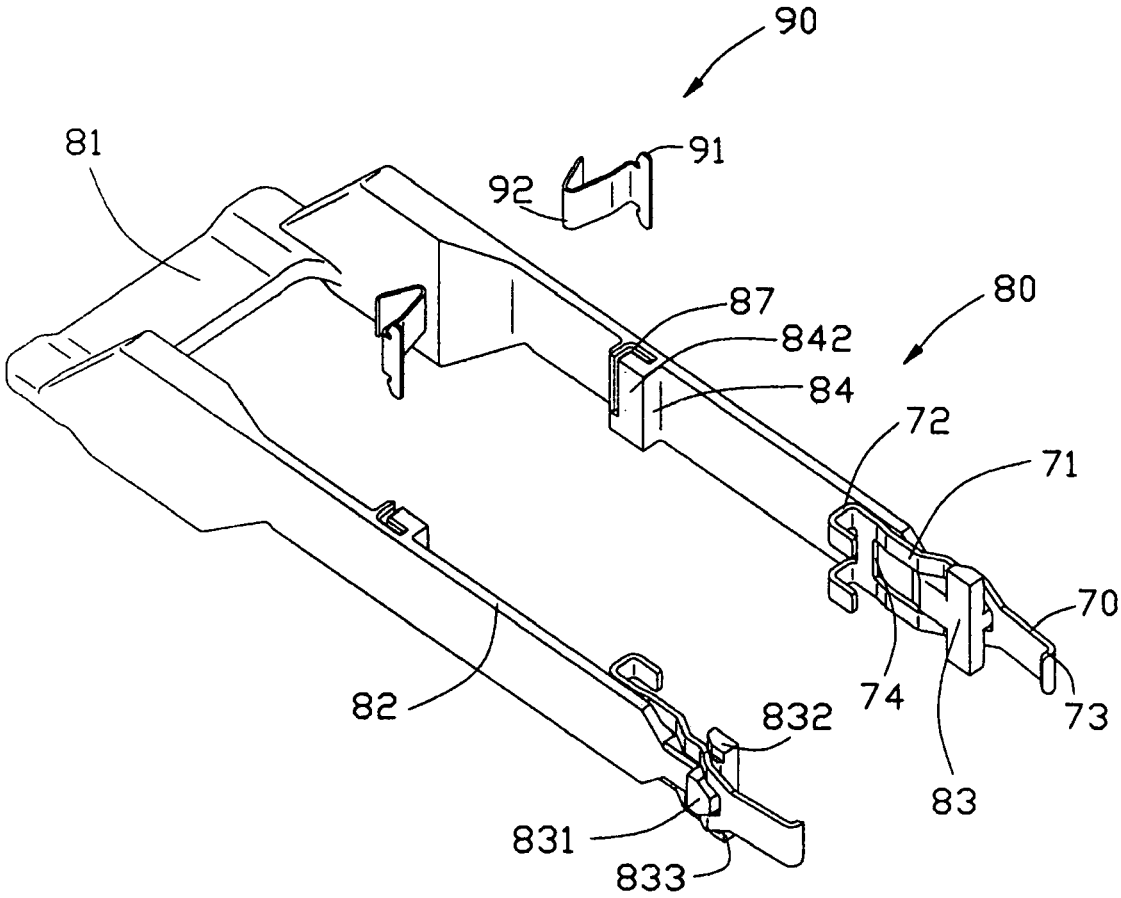
FIG. 5 is an enlarged, perspective view of a pull tab shown in FIG. 2.

Referring to FIG. 2 and FIG. 5, the first connector 1 is formed with a base 10, a cover 20 for being assembled to the base 10, a pair of screws 30 for securing the cover 30 on the base 10, a terminal module 60, a spring latch 70, a pull tab 80, and a pair of metal springs 90.

Figure 3:
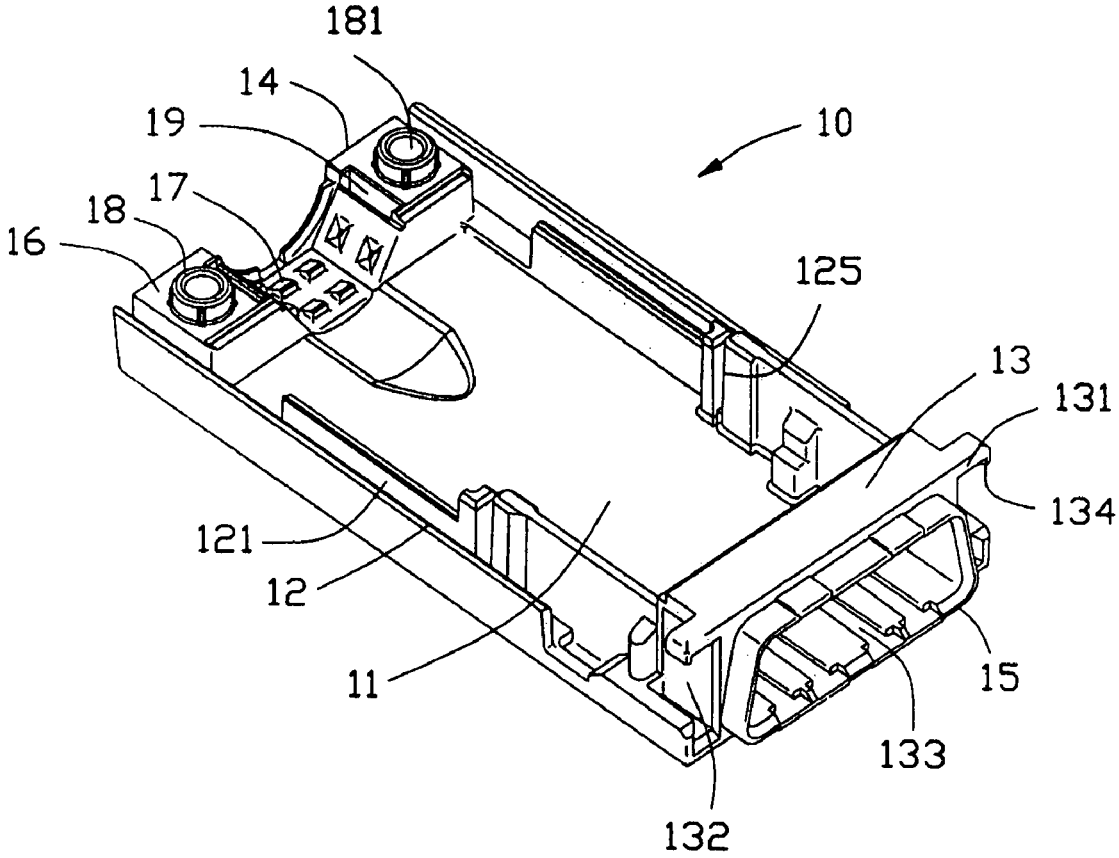
FIG. 3 is an enlarged, perspective view of a base member shown in FIG. 2.

The base 10 and the cover 20 are formed by die casting metallic material, for example, aluminum alloy. Referring to FIG. 3, the base 10 comprises a base plate 11 and a pair of sidewalls 12 upwardly extending from opposite lateral sides of the base plate 11. Each sidewall 12 defines an elongated channel 121 from a rear portion 14 toward a front end 15 of the base 10 and extending through a top engaging face 16 thereof. Each side wall 12 defines a vertical slit 125 at an inner side thereof in communication with the channel 121. A mating frame 13 is formed at the front end 15 of the base 10. The mating frame 13 defines an opening 133 through the front end 15. A pair of engaging ears 131 is formed on opposite top sides of the mating frame 13 and extends laterally. Each engaging ear 131 has a protrusion 134 downwardly extending from a free end thereof. A pair of engaging space 132 is defined in opposite sides of the mating frame 13 and between the engaging ears 131 and the base plate 11. The base 10 has a first substantially semicircular opening 17 at the rear end 14. A pair of grooves 19 is defined at opposite sides of the first opening 17. A pair of posts 18 protrudes upwardly from the engaging face 16. Each post 18 defines a screw hole 181 therein.

Figure 4:
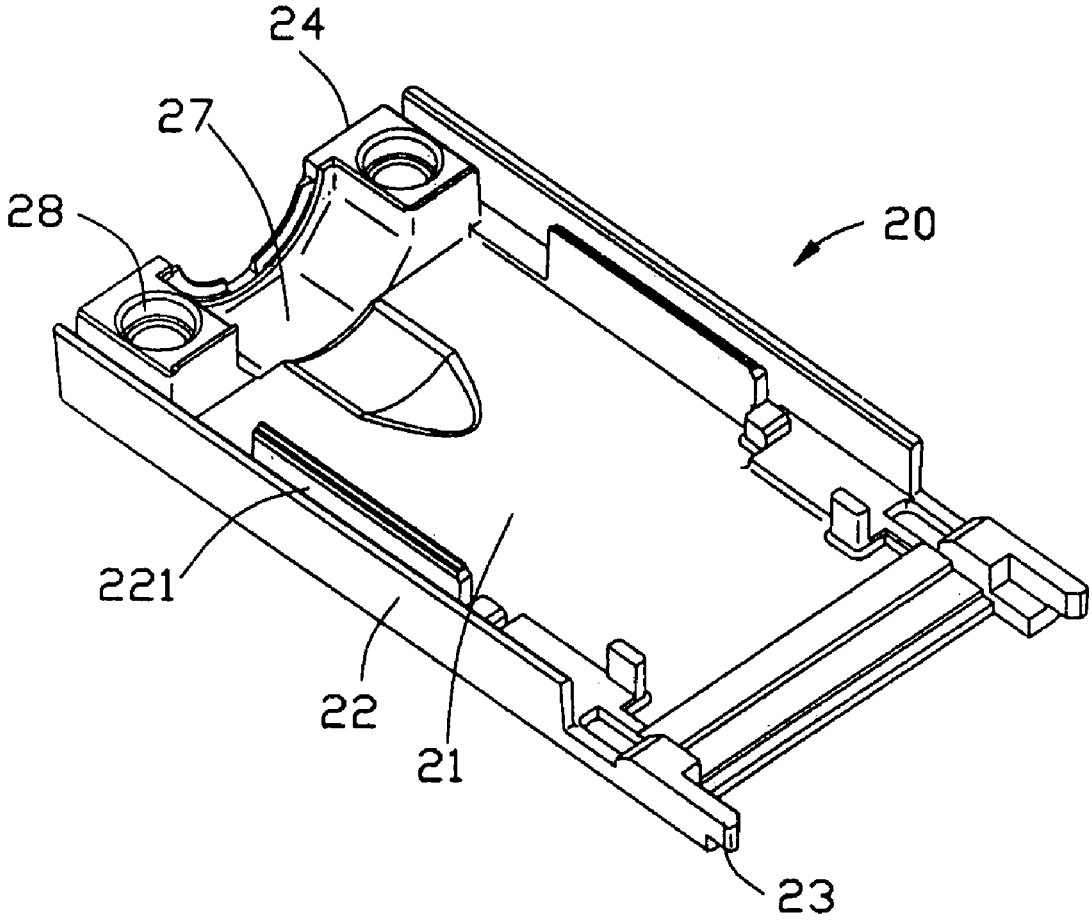
FIG. 4 is an enlarged, perspective view of a cover member shown in FIG. 2.

Particularly referring to FIG. 4, the cover 20 comprises a cover plate 21 and a pair of sidewalls 22 downwardly extending from opposite lateral sides of the cover plate 21. Each sidewall 22 defines an elongated channel 221 corresponding to the channel 121 of the base 10. A pair of projections 23 extends forwardly from opposite sides of a front end of the cover plate 21. A semicircular second opening 27 is defined in a rear end 24 of the cover plate 21 corresponding to the first opening 17 of the base 10. A pair of holes 28 is defined in the rear portion 24, locating at opposite sides of the second opening 27. Each hole 28 has a diameter generally equal to an outer diameter of each of the posts 18.

Referring to FIG. 5, each of the latch springs 70 is formed by stamping a metal sheet and has a body portion 71, a U-shaped claw portion 72 formed at a rear end of the body portion 71, and an L-shaped claw portion 73 formed at a front end of the body portion 71. An elongated cutout 74 is defined in the body portion 71 in a front to rear direction. The pull tab 80 comprises an operation portion 81, a pair of arms 82 extending forwardly from opposite sides of the operation portion 81, and a pair of latch releasing portions 83 formed at front ends of the arms 82, respectively. Each latch releasing portions 83 has upper and lower ends 832, 833, and a protrusion 831 protruding outwardly from an outside face thereof. Each arm 82 has a block 84 formed on inner side thereof. A pair of L-shaped slits 87 is defined in the blocks 84 from inner faces 842 of the blocks 84 to the arms 82. Each metal spring 90 comprises a retaining portion 91 and a U-shaped spring portion 92 extending from the retaining portion 91.

Figure 6:
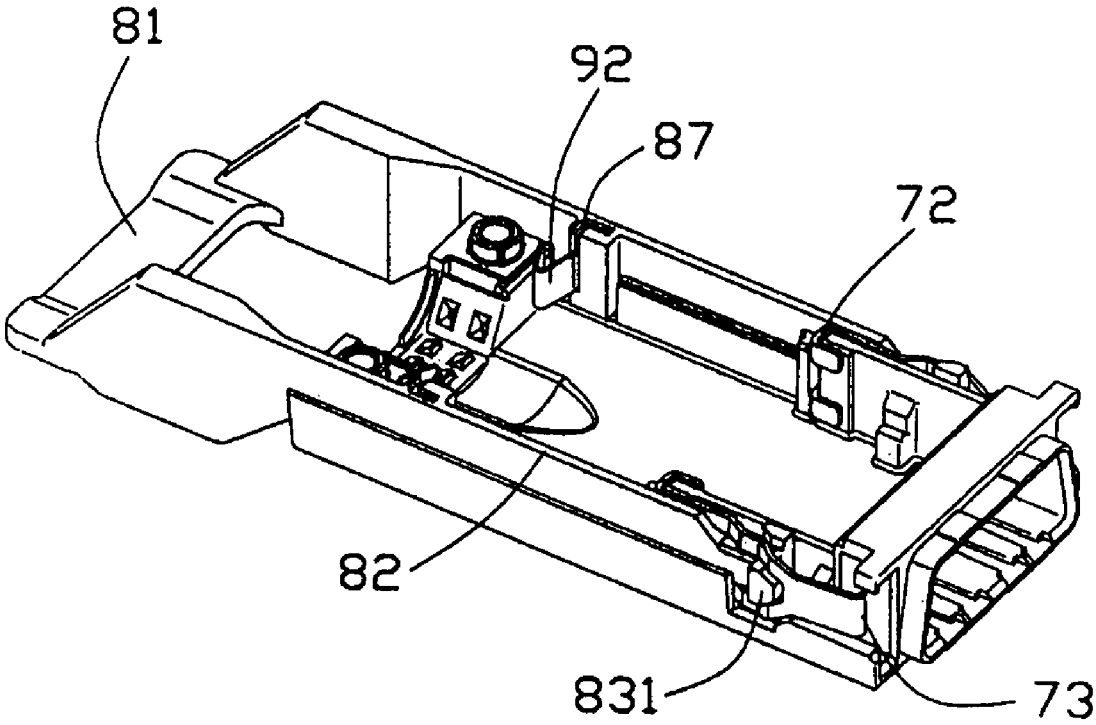
FIG. 6 is a view of the base member of the cable connector assembly of FIG. 3 with the pull tab shown in FIG. 5 and a pair of latch springs assembled thereto.

Referring to FIG. 6, the two latch springs 70 are respectively assembled to the pull tab 80 by extending the protrusions 831 into the cutouts 74 from inner faces of the latch springs 70, whereby the latch releasing portions 83 engage with the inner faces of the latch springs 70, respectively. The metal springs 90 are assembled to the pull tab 70 with the retaining portions 91 received in the slits 87. Then, the latch springs 70 together with the pull tab 80 and the metal springs 90 are assembled to the base 10. The arms 82 are placed into the channels 121 with the operation portion 81 located outside of the rear portion 14 of the base 10. The U-shaped claw portions 72 are received into the slits 125 to secure the latch springs 70 to the base 10. The L-shaped claw portions 73 extend into the engaging spaces 132.

Figure 7:
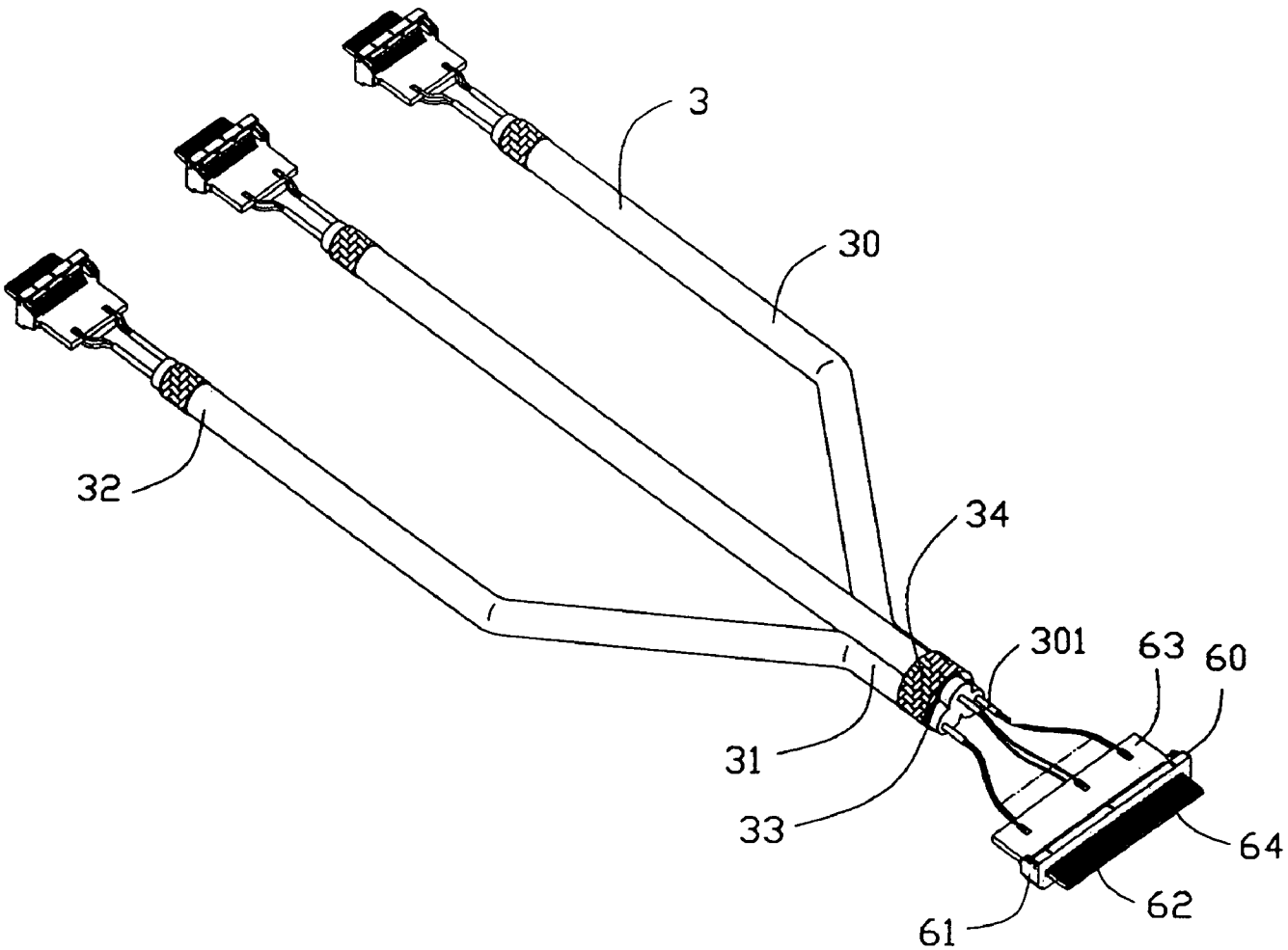
FIG. 7 is an enlarged, perspective view of a subassembly shown in FIG. 2.
Figure 8:
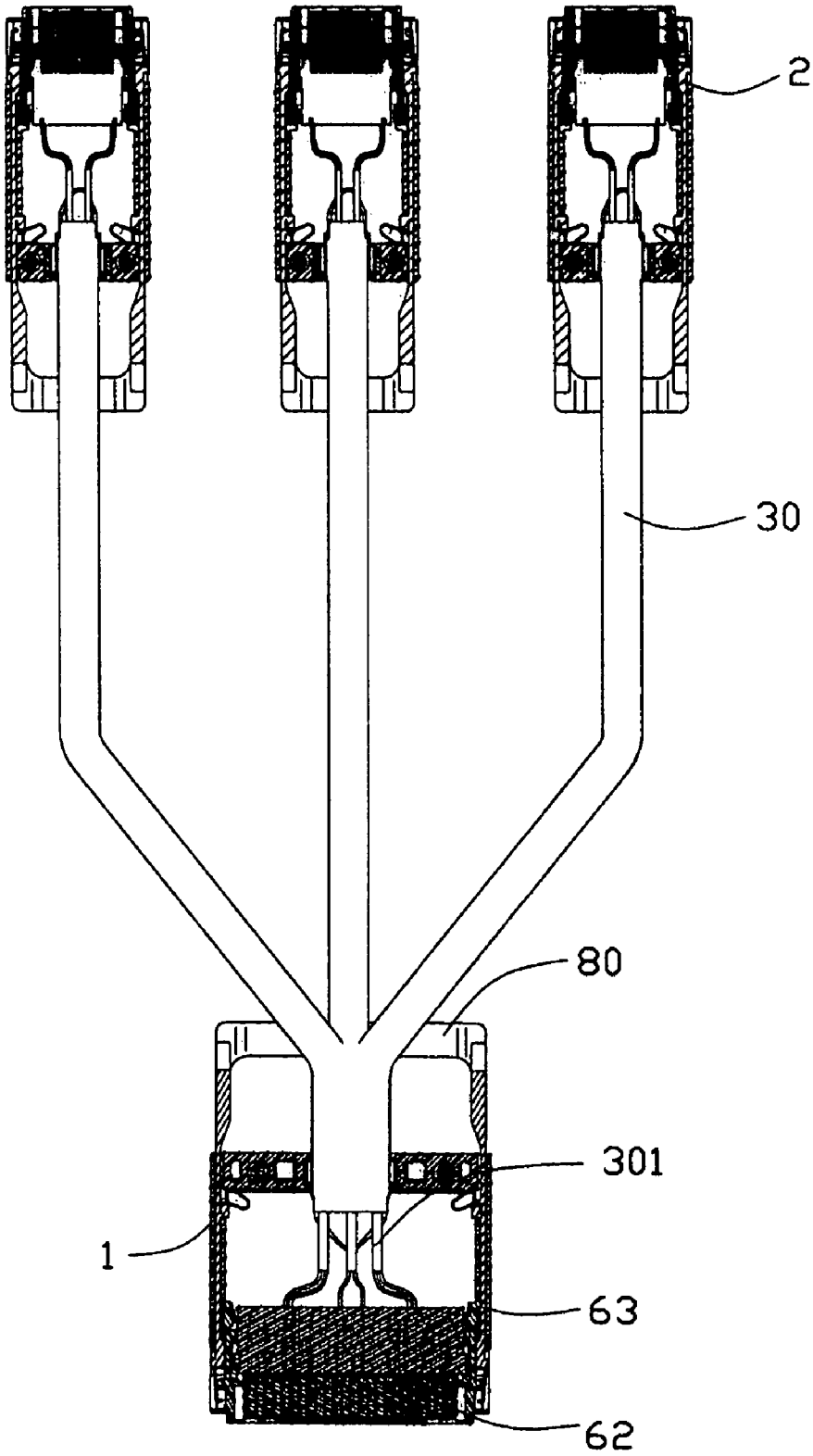
FIG. 8 is a cross-sectional view taken along line 8—8 of FIG. 1.
Figure 9:
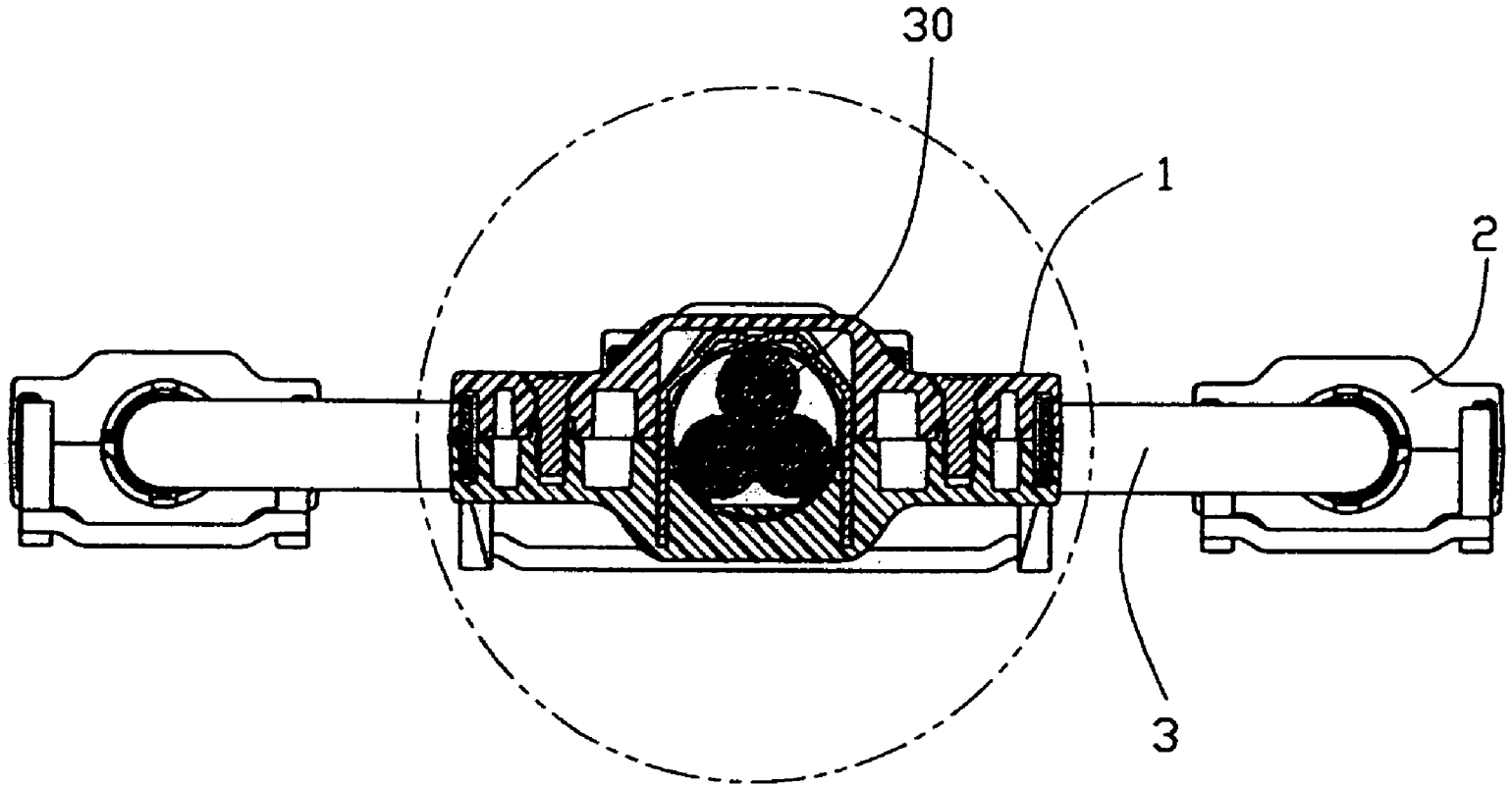
FIG. 9 is a cross-sectional view taken along line 9—9 of FIG. 1.

With reference to FIG. 7 and in conjunction with FIG. 9, the terminal module 60 comprises an insulative housing 61, a tongue board 62 extending forwardly from the housing 61, a circuit board 63 assembled to the housing 61 at a rear side thereof. A plurality of contacts 64 is received in the tongue board 62 and extends through the housing 61 to electrically connect the circuit board 63. The contacts 64 of each connector 1, 2 are composed of plural signal contacts and plural grounding contacts (not labeled), which are alternately disposed on opposite lengthwise sides of the tongue board 62.

Figure 10:
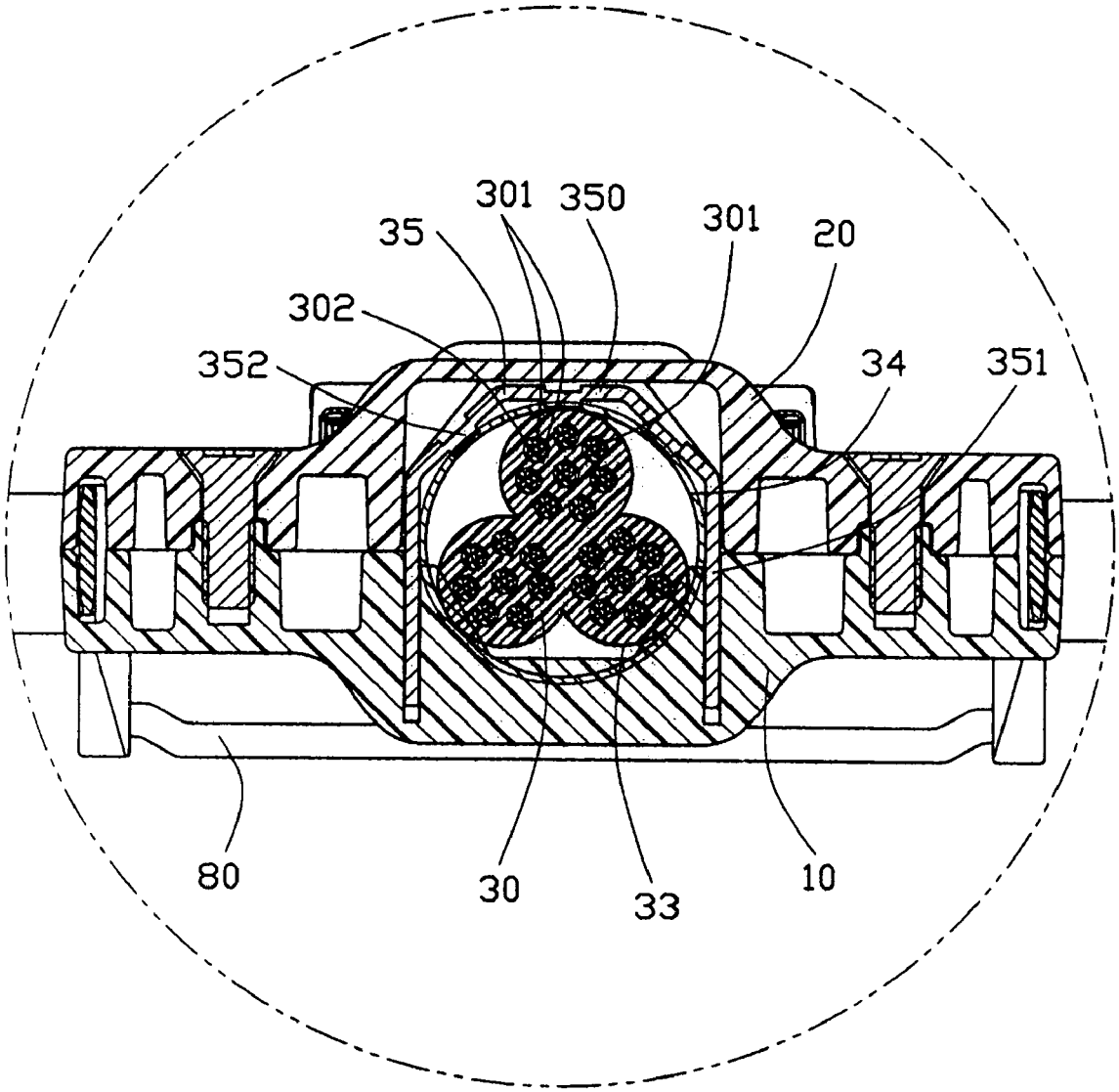
FIG. 10 is an enlarged view of an encircled area of FIG. 9.

The cable means 3 is formed with three individual 4×InfiniBand row cables 30. Each cable 30 comprises eight lines 301 therein. Particular referring to FIG. 10, each line 301 includes a pair of signal conductors 3011 and a ground conductor 3012. One ends of the cables 30 are bundled together by a conductive tape 33 and a peripheral conductive braid 34, thus forms a first end 31 of the cable means 3. Three sets of lines 301 of the first end 31 are juxtaposed in an array for soldering conductors 3011, 3012 to corresponding circuit traces of the circuit board 63 of the terminal module 60. The cable means 3 has three individual second ends 32, accommodating another ends of the cables 30, electrically connecting with corresponding circuit boards 63 of the second connectors 2, respectively. Each second end 32 is also bundled by the conductive tape 33 and the peripheral conductive braid 34.

Turning back to FIG. 1 in conjunction with FIGS. 2–8, the cable means 3 with the first end 31 and the second ends 32 thereof connected corresponding terminal modules 60 is assembled to the base 10 of the first connector 1 and the second connectors 2. A cable holder 35 is assembled to the base 10. The cable holder 35 comprises a semicircular body portion 350 partly surrounding the first end 31, and a pair of downwardly extending foot portions 351 insert into the grooves 19 of the base 10. The body portion 350 has a plurality of tabs 352 thereon for securely holding the conductive tape 33 and the peripheral conductive braid 34 together. Each foot portion 351 has a plurality of jags thereon for securing the cable holder 35 to the base 10. The cover 20 is assembled to the base 10 by placing the projections 23 beneath the pair of engaging ears 131. Then a rear portion of the cover 20 is rotated downwardly about the pair of engaging ears 131 until a bottom face of the cover 20 intimately abuts the engaging face 16 of the base 10. The arms 82 of the pull tab 80 are assembled between the cover 20 and the base 10. The posts 18 are received into the holes 28. The first and second opening 17 and 27 together form a cable receiving opening for extension of the first end 31 of the cable means 3. The cable means 3 could be integral manufactured with a common first end and three discrete second ends, if desired. That is to say, the unique cable means 3 comprises twenty-four lines terminated to the first connector 1, and then the lines is divided into three sets, each set includes eight lines respectively terminated to the second connectors.

It should be noted that the first connector 1 could be a 4×InfiniBand connector, which being connected with four 1×InfiniBand connector via a cable means. Obviously, this connecting device refers to the same conception and achieves the same objection of present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connecting device used for connecting multiple connectors, comprising:

a first connector and a plurality of second connectors, the first connector and each second connector comprising a plurality of contacts; and a cable means comprises a plurality of lines therein, one ends of the lines terminated to the first connector, and another ends of the lines divided into a plurality of individual sets, the another ends of the lines of each set terminated to a corresponding second connector;

wherein the first connector and the second connectors are of the same gender;

wherein the contacts of each first and second connector are composed of plural signal contacts and plural grounding contacts, which are alternately arranged in an array;

wherein the total number of the signal contacts of the second connectors is equal to that of the first connector;

wherein each first and second connector comprises a terminal module with the contacts assembled thereto connected with lines of the cable means;

wherein each of the first and second connectors comprises a shell enclosing a corresponding terminal module and defining an opening for extension of the cable means;

wherein each of the shell is composed of upper and lower halves, each of the upper and lower halves defining a semicircular opening;

wherein cable holders are assembled to the lower halves, the one ends of the lines and the another ends of the each line set held between the cable holders and the corresponding lower halves.

2. The electrical connecting device as described in claim 1, wherein the first connector and the second connectors comply with InfiniBand specification.

3. The electrical connecting device as described in claim 1, wherein the ends of lines terminated to the first connector and the ends of lines divided into plural sets respectively terminated to the second connectors are respectively bundled by a conductive tape and a peripheral conductive tape.

4. The electrical connecting device as described in claim 1, wherein the cable means is formed with a plurality of individual cables, each cable comprising a plurality of lines.

5. The electrical connecting device as described in claim 1, wherein each contact module comprises a circuit sheet electrically connected with the contacts, and wherein the lines of the cable means are respectively electrically connected with the contacts via the corresponding circuit sheets.

6. The electrical connecting device as described in claim 1, wherein each of the lower halves forms a mating frame at a front end thereof, with a front portion of a corresponding terminal module disposed in a center.

7. The electrical connecting device as described in claim 1, wherein each of the first and second connector further comprises a pull tab assembled between the upper and the lower halves, and a pair of latch springs assembled on the pull tab.

8. The electrical connecting device as described in claim 1, wherein the cable holder comprises a semicircular body portion and a pair of foot portion secured to the lower half.

* * * * *